US006367265B1

(12) United States Patent
Yamamoto et al.

(10) Patent No.: US 6,367,265 B1
(45) Date of Patent: Apr. 9, 2002

(54) VAPORIZER FOR A LOW TEMPERATURE LIQUID

(75) Inventors: Shuji Yamamoto; Yasuhiro Ueno, both of Osaka; Susumu Terada, Takasago; Kozo Nakaoki, Tokyo; Kuniteru Sugino, Takasago, all of (JP)

(73) Assignee: Kabushiki Kaisha Kobe Seiko Sho., Kobe (JP)

( * ) Notice: Subject to any disclaimer, the term of this patent is extended or adjusted under 35 U.S.C. 154(b) by 0 days.

(21) Appl. No.: 09/585,438

(22) Filed: Jun. 2, 2000

(30) Foreign Application Priority Data

Jun. 28, 1999 (JP) ..... 11-181620

(51) Int. Cl.[7] ..... F17C 7/02
(52) U.S. Cl. ..... 62/50.2; 62/52.1
(58) Field of Search ..... 62/50.2, 52.1, 62/50.4

(56) References Cited

U.S. PATENT DOCUMENTS 2,480,472 A * 8/1949 Jackson ..... 62/52.1
2,966,040 A * 12/1960 Henry ..... 62/52.1
3,986,340 A * 10/1976 Bivins ..... 62/50.2
4,718,481 A * 1/1988 Delatte ..... 165/108
5,582,015 A * 12/1996 Davidson ..... 62/50.2
5,819,542 A * 10/1998 Christiansen et al. ..... 62/7

FOREIGN PATENT DOCUMENTS

JP 8-334291 12/1996

* cited by examiner

*Primary Examiner*—William Doerrler
(74) *Attorney, Agent, or Firm*—Reed Smith LLP

(57) ABSTRACT

Disclosed are a method and a device for effectively restraining the generation of thermal stress when effecting slow cooling at the time of starting, etc. of a heat exchanger for heating a low temperature liquid. In a method for effecting slow cooling in a heat exchanger equipped with an inlet chamber into which a low temperature liquid is introduced, the low temperature liquid is sprinkled in the inlet chamber at a lower flow rate during slow cooling than during normal operation. A slow cooling device is equipped with a slow cooling LNG supplying means having a sprinkling means for sprinkling the low temperature liquid.

8 Claims, 6 Drawing Sheets

VAPORIZER FOR A LOW TEMPERATURE LIQUID

BACKGROUND OF THE INVENTION

1. Field of the Invention

The present invention relates to a vaporizer for vaporizing a low temperature liquid such as liquefied natural gas (hereinafter referred to as LNG) by using a heat exchange with a heating medium.

2. Description of the Related Art

As a means for vaporizing a low temperature liquid such as LNG, a heat exchange between a low temperature liquid and a heating medium is generally used. For example, Japanese Patent sho 53-5207 discloses an intermediate medium type vaporizer that uses an intermediate medium in addition to the heat source fluid, vaporizing LNG by using heat exchange between the intermediate medium and the LNG.

FIG. 7 shows an example of such a heat exchanger. The diagram shows a LNG vaporizer, which comprises an intermediate medium evaporator E1, a LNG evaporator E2, and a natural gas (hereinafter referred to as NG) heater E3. Further, as a path for the heat source fluid (which is sea water in the example shown), there are sequentially arranged an inlet chamber 10, a large number of heat source tubes 12, an intermediate chamber 14, a large number of heat source tubes 16, and an outlet chamber 18, the heat source tubes 12 and the heat source tubes 16 being provided in the NG heater E3 and the intermediate medium evaporator E1, respectively. In the intermediate medium evaporator E1, there is accommodated an intermediate medium (such as propane) 17 whose boiling point is lower than that of sea water, which is the heat source fluid.

As shown in FIG. 8, the LNG evaporator E2 comprises a capsule-shaped shell 21, the closed end portion of which is separated from the other portion by a tube plate 25. Further, a horizontal partition 20 is secured in the closed end portion, whereby there are defined an inlet chamber 22 and an outlet chamber 24, which are separated from each other, the chambers 22 and 24 communicating with a large number of substantially U-shaped heat transfer tubes 23. The intermediate portion of each heat transfer tube 23 protrudes in the upper portion of the intermediate medium evaporator E1, and the end portions thereof pass through the tube plate 25 and secured thereto.

In the inlet chamber 22, there is provided an LNG supply portion 28 for introducing LNG, the LNG supply portion 28 being connected to an LNG supply source through a supply passage (not shown). In the outlet chamber 24, there is provided an NG discharge means 29, which is connected to the interior of the NG heater E3 through an NG duct 26.

In this vaporizer, sea water, which is the heat source fluid, passes the inlet chamber 10, the heat source tubes 12, the intermediate chamber 14, and the heat source tubes 16 before it reaches the outlet chamber 18. Heat exchange is performed between the sea water passing through the heat source tubes 16 and the liquid intermediate medium 17 in the intermediate medium evaporator E1 to vaporize the intermediate medium 17.

LNG, which is the object of vaporization, is introduced into the heat transfer tubes 23 from the inlet chamber 22. Through heat exchange between the LNG in the heat transfer tubes 23 and the evaporation intermediate medium 17 in the intermediate medium evaporator E1, the intermediate medium condenses, the heat of condensation vaporize the LNG and consequently NG is obtained. This NG is introduced into the NG heating chamber E3 from the outlet chamber 24 through the NG duct 26, and is further heated by heat exchange with the sea water flowing through the tubes 12 in the NG heating chamber E3 and then supplied to the place where it is required.

In the above LNG vaporizer (and other low temperature liquid heating heat exchangers of various types), a large thermal stress is generated when the low temperature liquid is abruptly introduced at a great flow rate at the time of starting. In view of this, at the time of speaking, as shown in FIG. 8, the supply flow rate is reduced to perform slow cooling operation, in which LNG is supplied little by little from the LNG supply portion 28 to the inlet chamber 22.

However, when the flow rate is thus reduced and LNG is caused to flow out little by little from the LNG supply portion 28, the LNG first flows down to the bottom portion of the shell 21, and then spreads over the entire inlet chamber 22, so that the bottom portion of the inlet chamber 22 is locally cooled prior to the other portions. For example, in the structure shown in FIG. 8, a marked temperature gradient as shown in FIG. 9 is generated during slow cooling, and thermal stress attributable to this temperature gradient is generated.

That is, it is difficult to effectively mitigate the thermal stress generated in the inlet chamber 22 solely by reducing the LNG supply flow rate as in the prior art. In particular, in a heat exchanger, which is frequently started/stopped, there is a fear of fatigue failure being generated in, for example, the welding portion between the shell 21 and the tube plate 25 or the welding portion between the tube plate 25 and the partition 20. Further, a similar temperature gradient is liable to be generated not only at the time of starting but when the LNG flow rate is reduce to maintain slow cooling at the time of temporary interruption of the operation of the heat exchanger.

SUMMARY OF THE INVENTION

The present invention has been made in view of the above problems. It is an object of the present invention to provide a vaporizer for vaporizing a low temperature liquid in which it is possible to effectively restrain the generation of thermal stress when effecting slow cooling at the time of starting, etc.

To achieve the above object, there is provided in accordance with the present invention a method for effecting slow cooling in a heat exchanger for heating a low temperature liquid which is equipped with an inlet chamber in which the low temperature liquid is introduced, wherein, when effecting slow cooling, the low temperature liquid is sprinkled in the inlet chamber at a flow rate lower than that at the time of normal operation.

In this method, the low temperature liquid is diffused and supplied to a wide region in the inlet chamber at a flow rate lower than that at the time of normal operation, so that the temperature gradient generated in the inlet chamber is reduced, thereby effectively mitigating the thermal stress.

More specifically, the inlet chamber is equipped with a normal operation supply means and a slow cooling supply means with a sprinkling function; during normal operation, the low temperature liquid is supplied at least from the normal operation supply means to the inlet chamber, and, during slow cooling, the low temperature liquid is supplied solely from the sprinkling means, whereby it is possible to supply a low temperature liquid suitable for slow cooling to the inlet chamber through the dedicated slow cooling supply means at the time of slow cooling, and, after the completion of the slow cooling, it is possible to supply an LNG suitable for normal operation by the normal operation supply means.

Further, in accordance with the present invention, the above methods is performed by a vaporizer comprising an inlet chamber, a heat transfer tube into which the low temperature liquid is introduced from said inlet chamber and in which the low temperature liquid is vaporized, and means for sprinkling the low temperature liquid in said inlet chamber.

As the means for sprinkling, various types can be adopted. For example, by constructing the means for sprinkling such that the low temperature liquid is sprinkled from a plurality of places in the inlet chamber, it is possible to further widen the sprinkling region than in the case in which the liquid is sprinkled from a single place.

Further, by installing the means for sprinkling such that at least a part of the upper half of the inner wall of the inlet chamber is included in the sprinkling region, the low temperature liquid gradually flows down after being sprinkled against the upper half of the inner wall, so that it is possible to spread the low temperature liquid more uniformly.

Further, by installing the means for sprinkling such that the welding portion in the inlet chamber is included in the sprinkling region, it is possible to simultaneously cool a plurality of members on either side of the welding portion, so that the difference in temperature between these members is reduced, whereby it is possible to more effectively prevent breakage due to the thermal stress at the welding portion attributable to the difference in temperature.

In this device also, it is more desirable to provide the inlet chamber with the means for sprinkling and a normal operation supply means for supplying the low temperature liquid at a higher flow rate than the means for sprinkling.

In that case, by providing a supply passage branching off from a common low temperature liquid supply source to the normal operation supply means and to the means for sprinkling, and by providing in the supply passage leading to the means for sprinkling a flow rate varying means for varying the supply flow rate independently of the supply passage leading to the normal operation supply means, it is possible to free adjust the low temperature liquid supply amount during slow cooling according to the situation.

The flow rate varying means may be a remote control valve which varies the flow rate of the low temperature liquid through manual remote control, or a temperature adjusting valve which adjusts the flow rate of the low temperature liquid so as to maintain the temperature in the inlet chamber at a preset target temperature. In the latter case, it is possible to automatically perform an operation for maintaining the temperature in the inlet chamber at a predetermined temperature, for example, during temporary interruption of the operation of the heat exchanger (so-called cool down maintaining operation).

In the present invention, there is no particular restriction regarding the concrete structure of the entire heat exchanger. However, in a structure in which the inlet chamber is adjacent to the outlet chamber for the low temperature liquid evaporation kuro through the intermediation of a partition, the partition is heated by the heated fluid passing the outlet chamber, and the difference in temperature between the partition and the other members constituting the inlet chamber tends to increase, so that the application of the present invention to the heat exchanger is particularly effective.

DESCRIPTION OF THE PREFERRED EMBODIMENTS

Figure 8:
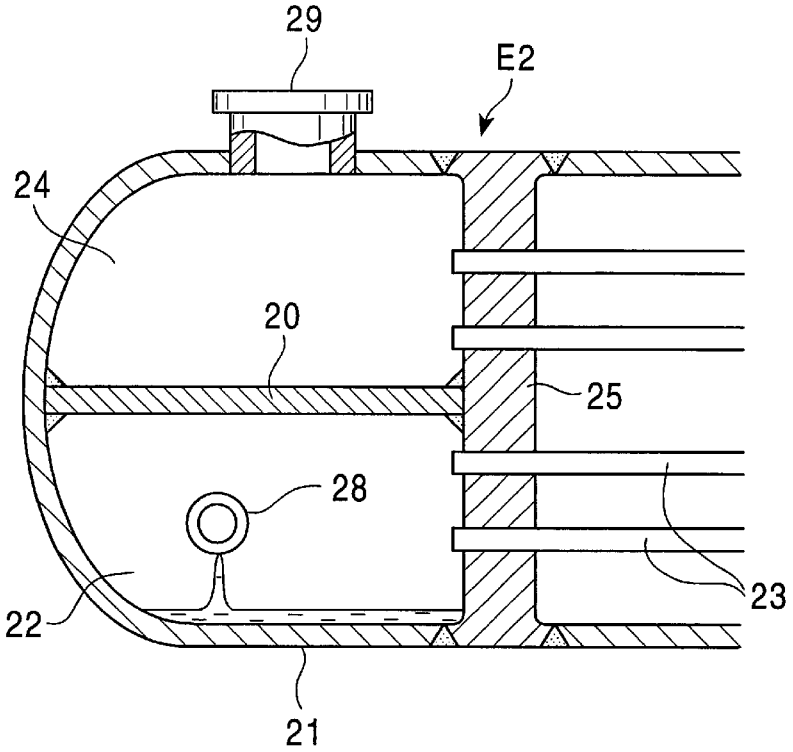
FIG. 8 PRIOR ART
FIG. 8 is a sectional view of an inlet chamber of a conventional LNG evaporator.
Figure 9:
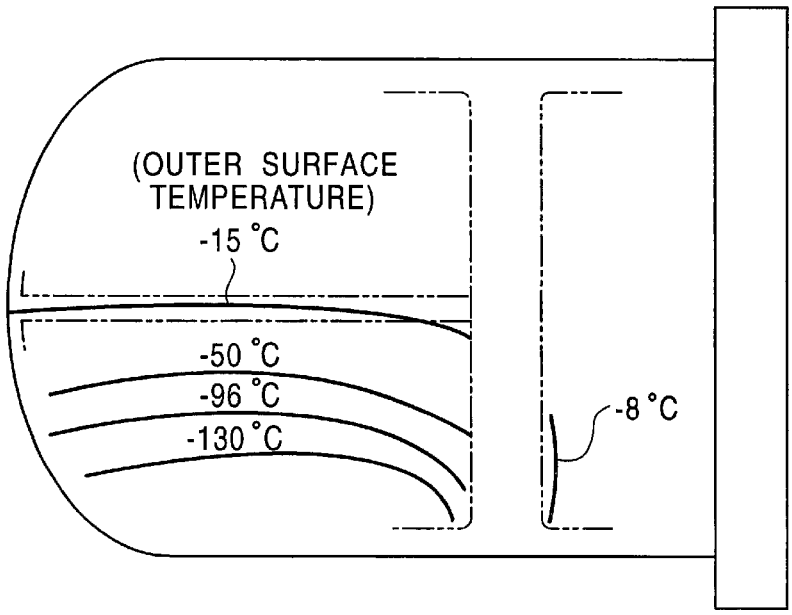
FIG. 9 PRIOR ART
FIG. 9 is a diagram showing the temperature gradient of the inlet chamber in the conventional LNG evaporator.

FIGS. 1 to 4 show one embodiment of the present invention. The construction of this embodiment shown in FIGS. 1 and 2 differs from the conventional construction shown in FIG. 8 in that the inlet chamber 22 is provided, in addition to the tubular LNG supply portion 28 for normal operation, with a means for sprinkling 30 and situated at a position further spaced apart from the tube plate 25 than the normal operation LNG supply 28 (a position on the left-hand side in FIGS. 1 and 2).

In the present invention, there is no particular restriction regarding the positional relationship between the normal operation LNG supply portion 28 and the means for sprinkling 30.

Figure 2:
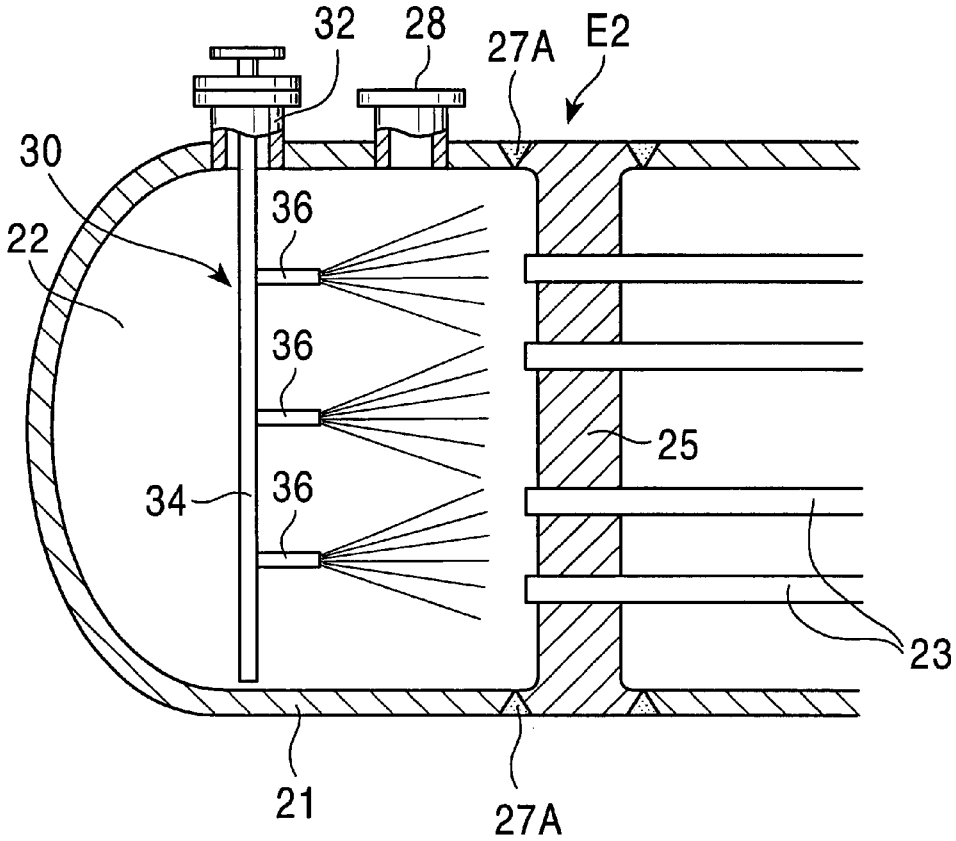
FIG. 2 is a sectional view taken along the line I—I of FIG. 1.

In FIG. 2, a main trunk portion 34 is extended from the inlet portion 32 in the shell width direction (the vertical direction in FIG. 2). A plurality of sprinkling portion 36 is arranged in the longitudinal direction of the main trunk portion 34.

Figure 3A:
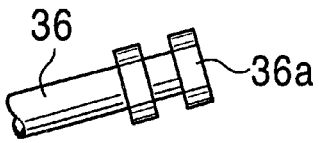
FIGS. 3A and 3B show sprinkling portion of the present invention.
Figure 3B:
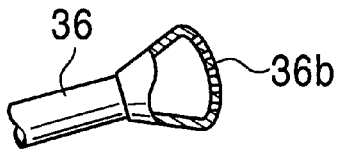

Each sprinkling portion 36 may have any construction as long as it is capable of sprinkling LNG force-fed through the main trunk portion 34. Suitable examples of the sprinkling portion include a spray nozzle 36*a* as shown in FIG. 3A and a porous plate shower nozzle 36B as shown in FIG. 3B. It is also possible to employ a construction in which a single spray nozzle is provided, sprinkling being performed by swinging the nozzle.

Figure 1:
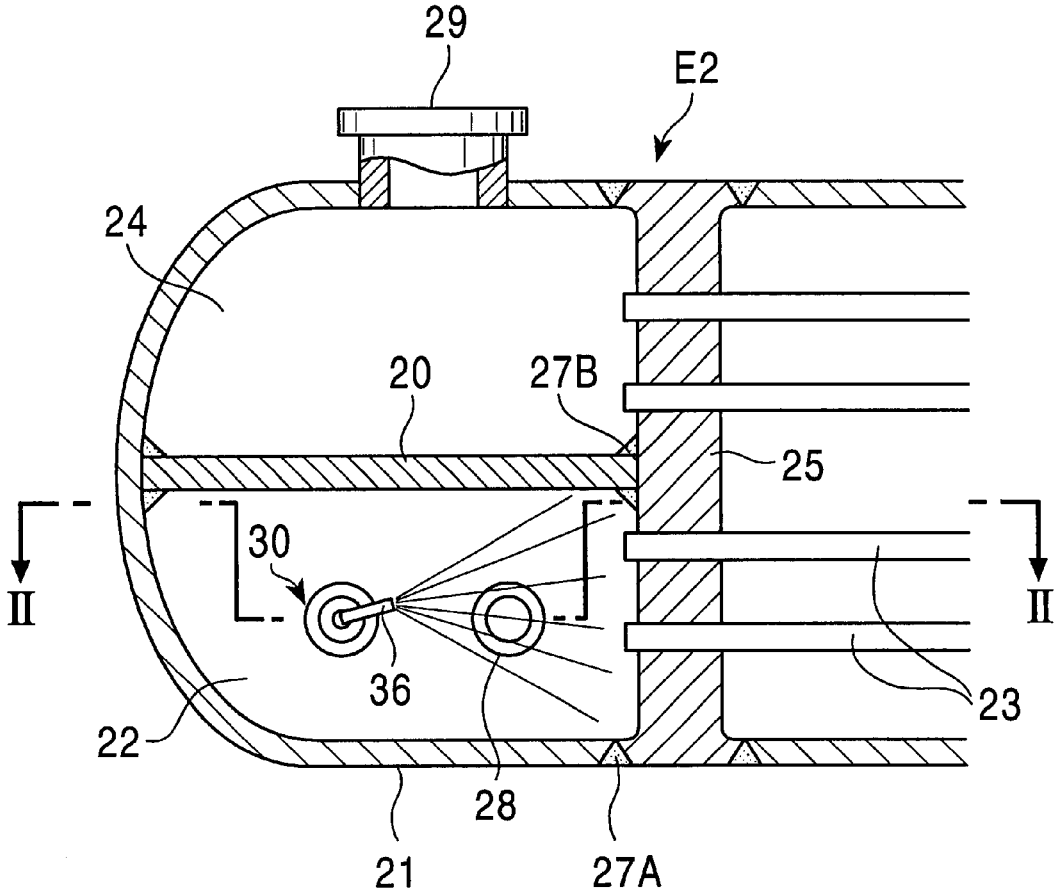
FIG. 1 is a sectional view of an inlet chamber of an LNG evaporator according to the present invention.

As shown in FIG. 1, in this embodiment, each sprinkling portion 36 is directed somewhat obliquely upward, and the sprinkling portion 36 are arranged such that the sprinkling region substantially includes the entire inner wall of the tube plate 25, the joint portion (welding portion) 27A between the bottom wall of the shell 21 and the tube plate 25, and the joint portion (welding portion) 27B between the tube plate 25 and the partition 20.

Figure 4:
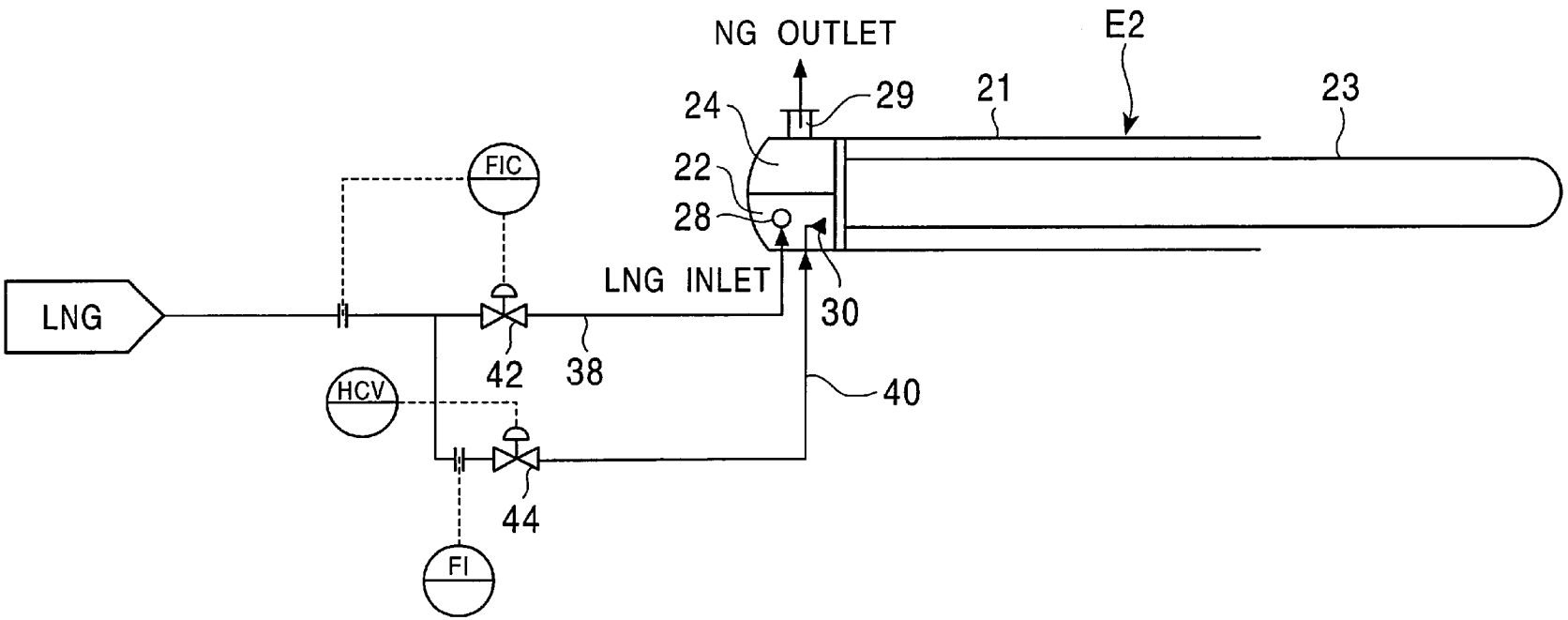
FIG. 4 is a diagram showing one system for supplying LNG to the LNG evaporator.

FIG. 4 shows the LNG supply system of this embodiment. The supply passage from the LNG supply source branches into a normal operation supply passage 38 and a slow cooling supply passage 40; the normal operation supply passage 38 is connected to the normal operation LNG supply portion 28, and the slow cooling supply passage 40 is connected to the means for sprinkling 30.

Remote control valves 44 as the flow rate adjusting means are individually provided in the supply passages 38 and 40. The remote control valve 44 on the normal operation supply passage 38 side operates to as to maintain the LNG supply flow rate at a preset target flow rate. The other remote control valve 44 allows manual remote control (flow rate adjustment).

Next, the operation method for this device will be described.

First, when the device is started at room temperature, the flow rate adjusting valve 42 is closed to reduce the LNG flow rate in the normal operation supply passage 38 to zero, and the remote control valve 44 is opened to an appropriate degree to supply LNG to the inlet chamber 22 through the slow cooling passage 40 at a low flow rate (a flow rate lower than that during normal operation). This LNG is distributed to the sprinkling portion 36 from the main trunk portion 34 and sprinkled over a wide range from the sprinkling portion 36 toward the tube plate 25.

Thus, in this slow cooling method, there is substantially no fear of exclusively the lower portion of the inlet chamber 22 being locally cooled as in the conventional slow cooling method, in which LNG is caused to flow down little by little from the normal operation LNG supply portion 28, and the interior of the inlet chamber 22 is cooled substantially uniformly over the entire vertical range. As a result, the thermal stress generated in the member forming the inlet chamber 22 is effectively mitigated. In particular, when, as shown in the drawing, the joint portion (welding portion) 27B between the partition 20 and the tube plate 25 and the joint portion (welding portion) 27A between the tube plate 25 and the shell 21 are included in the sprinkling region, it is possible to more reliably reduce the difference in temperature between the partition 20 and the tube plate 25 and between the tube plate 25 and the shell 21, whereby it is possible to more effectively prevent fatigue breakage of the welding portions due to thermal stress attributable to the difference in temperature.

After the slow cooling has been thus completed, the remote control valve 44 is totally closed, or the flow rate adjusting valve 42 is operated, with the remote control valve 44 being open, supplying LNG through the normal operation supply passage 38 and the normal operation LNG supply portion 28 as in the prior art. It can be determined whether the slow cooling has been completed or not by monitoring, for example, the temperature in the inlet chamber 22.

Figure 5:
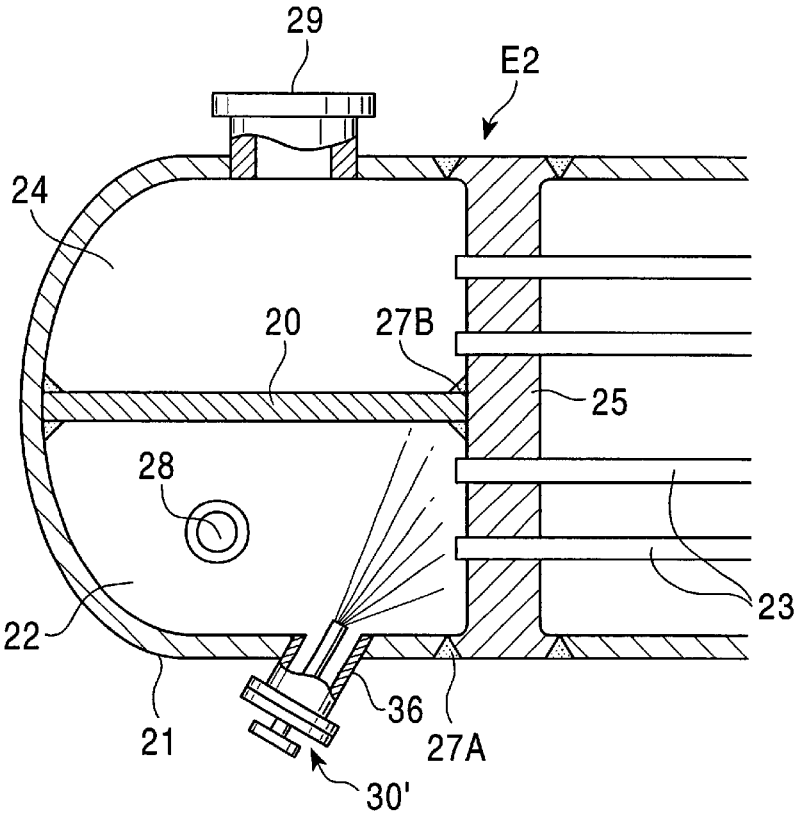
FIG. 5 is a sectional view of an inlet chamber of one embodiment of the present invention.

FIG. 5 shows a second embodiment. In this embodiment, the main trunk portion 34 of the first embodiment is omitted, and the sprinkling portion 36 is directly mounted to the bottom wall of the shell 21. The sprinkling portion sprinkles LNG obliquely upward, and is arranged such that the joint portion (welding portion) 27B between the partition 20 and the tube plate 25 is included in the sprinkling region.

In this embodiment also, the upper half of the inner wall of the inlet chamber 22 is included in the sprinkling region, so that, in particular, the local cooling of the lower portion of the inlet chamber 22 is mitigated, thereby preventing the generation of large thermal stress. Further, since the joint portion (welding portion) between the partition 20 and the tube plate 25 is included in the sprinkling region, it is possible to more effectively prevent fatigue breakage in the welding portion.

Further, in this embodiment also, it is possible to arrange and distribute a plurality of sprinkling portion 36. However, if only one sprinkling portion 36 is provided, or if the sprinkling region is other than the region shown in the above embodiment, it is possible in the present invention to mitigate through sprinkling the generation of thermal stress in the inlet chamber 22 to a higher degree than in the prior art.

Apart from the above, the following embodiment, for example, is also possible in the present invention.

In the supply system shown in FIG. 4, when, instead of the remote control valve 44 shown in the drawing, a temperature adjusting valve operating so as to maintain the temperature in the inlet chamber 22 at a preset target temperature is provided, it is possible to apply the present invention, for example to slow cooling when the operation of the heat exchanger is temporarily interrupted. Further, it goes without saying that the slow cooling operation at temporary interruption can be manually effected by using the remote control valve 44.

In the present invention, there is no particular restriction regarding the concrete structure of the inlet chamber 22. For example, the present invention is also applicable to a construction in which the inlet chamber 22 is formed independently at a position spaced apart from the outlet chamber 24. However, in the construction shown in the drawing, in which the inlet chamber 22 is adjacent to the outlet chamber 24 through the intermediation of a partition member such as the partition 20, the partition 20 is maintained at a relatively high temperature, and the temperature gradient with respect to the shell bottom wall on the opposite side is steep, so that a more remarkable effect can be achieved by applying the present invention to this construction.

In the present invention, there is no particular restriction regarding the kind of low temperature liquid for the heat exchanger, and the present invention can be widely applied to heat exchangers heating low temperature liquids other than LNG. Further, the general construction of the heat exchanger is not restricted to an intermediate medium type as described above; the present invention is also applicable to a construction in which heat exchange is directly effected between the low temperature liquid and a heat source such as sea water or to a construction in which heat exchange is effected between the low temperature liquid and the atmospheric air.

EXAMPLES

Figure 6:
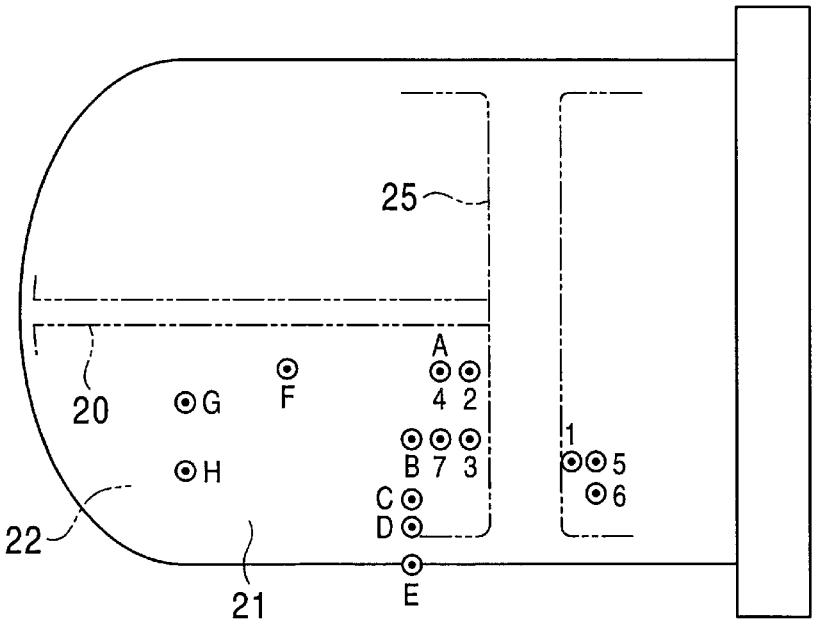
FIG. 6 is a sectional view of a thermocouple and a distortion gage in an embodiment of the present invention.
Figure 7:
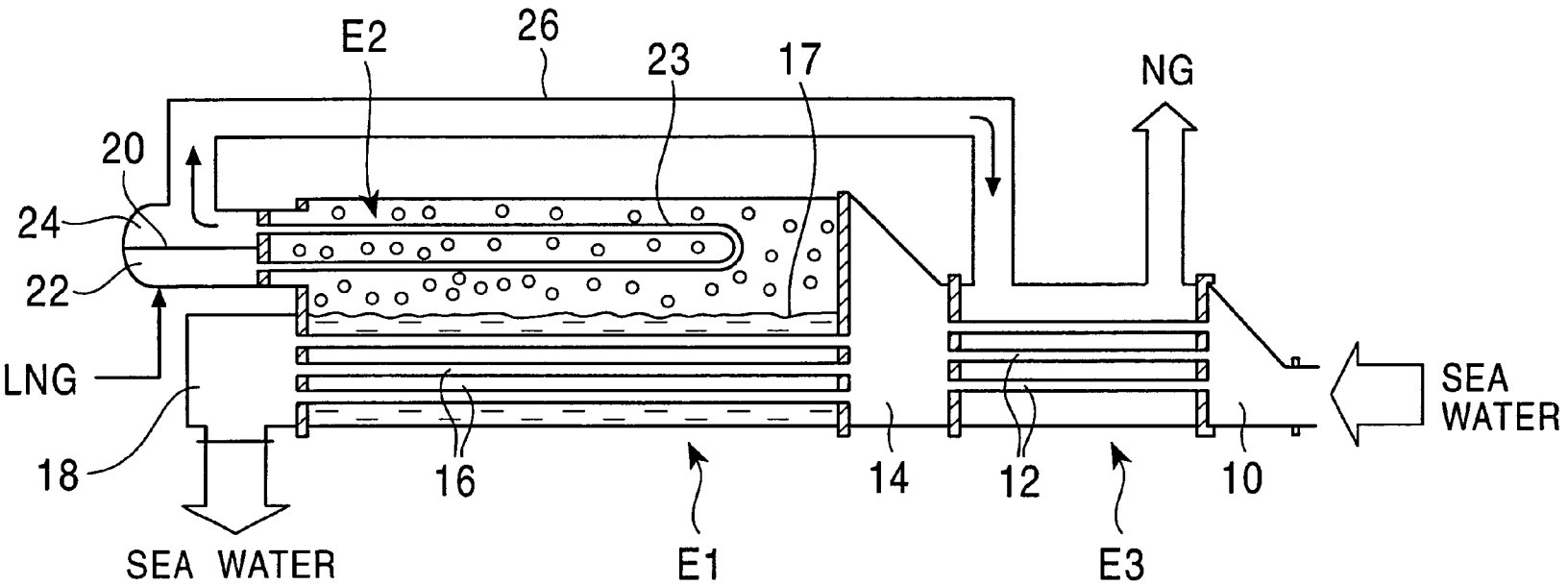
FIG. 7 is sectional view of an intermediate medium type vaporizer equipped with an LNG evaporator which is an example of a heat exchanger for a low temperature liquid.

Thermocouples were arranged at eight positions A, B, C, D, E, F, G and H shown in FIG. 6, and distortion gages were arranged at seven positions 1, 2, 3, 4, 5, 6 and 7 shown in the drawing to measure temperature distribution and thermal stress distribution when the conventional slow cooling method and the method of the present invention were carried out. The results are shown in Tables 1 and 2.

TABLE 1

| Thermocouple | Temperature Distribution (° C.) | |
|---|---|---|
| No. | Prior Art | Present Invention |
| A | −32 | −71 |
| B | −84 | −100 |
| C | −133 | −142 |
| D | −142 | −145 |
| E | −142 | −145 |
| F | −26 | −68 |
| G | −47 | −85 |
| H | −130 | −135 |

TABLE 2

| Thermal Stress Distribution (kg/mm$^2$) | | | | |
|---|---|---|---|---|
| | Prior Art | | Present Invention | |
| Distortion Gage No. | Circumferential | Axial | Circumferential | Axial |
| 1 | -11.7 | 0.1 | -6.8 | 1.7 |
| 2 | -1.3 | -9.1 | -2.3 | -3.0 |
| 3 | -6.2 | -18.8 | 0.1 | -6.0 |
| 4 | 1.6 | -4.6 | 3.2 | 0.2 |
| 5 | -4.6 | 7.1 | -3.3 | 6.0 |
| 6 | -5.6 | 9.7 | -4.5 | 5.6 |
| 7 | -1.9 | -5.6 | -1.1 | -4.2 |

Figures in boxes indicate maximum stress generation

As shown in these tables, as compared with the conventional slow cooling method, in accordance with the present invention, the temperature is uniformalized, the maximum value of the circumferential thermal stress (distortion gage No. 1, conventional method: −11.7 kg/mm$^2$, present invention: −6.8 kg/mm$^2$) is reduced to approximately 60%, and maximum value of the axial thermal stress (distortion gage No. 3, conventional method: −18.8 kg/mm$^2$, present invention: −6.0 kg/mm$^2$) is reduced to approximately 30%.

Table 3 shows the requisite starting time of the main body when the above operation is performed. As shown in this table, while in the conventional method it is impossible to increase the LNG flow rate during slow cooling, the present invention makes it possible to increase the LNG flow rate during slow cooling as compared to the prior art to reduce the requisite starting time to approximately ½ while realizing the thermal stress mitigation as described above.

TABLE 3

| | Prior Art | Present Invention |
|---|---|---|
| Rated LNG Processing Amount | 150 tons/H | 150 tons/H |
| LNG Flow Rate During Slow Cooling | Approx.1.0 ton/H | Approx.1.7 ton/H |
| Requisite Starting Time for Main Body | Approx. 3 hours | Approx. 2 hours |

As described above, in accordance with the present invention, there is provided a method in which, when introducing a low temperature liquid into the inlet chamber of a heat exchanger, the flow rate at which the low temperature liquid is sprinkled in the inlet chamber is lower during slow cooling than during normal operation. Further, there is provided a device equipped with means for sprinkling the liquid, whereby it is possible to reduce the temperature gradient generated during slow cooling to thereby effectively restrain the generation of thermal stress.

What is claimed is:

1. A vaporizer for a low temperature liquid, comprising:

an inlet chamber;

a heat transfer tube into which the low temperature liquid is introduced from said inlet chamber and in which the low temperature liquid is vaporized; and means for sprinkling the low temperature liquid in said inlet chamber so as to vaporize the low temperature liquid and mitigate thermal stress created therein.

2. The vaporizer according to claim 1, wherein the means for sprinkling is installed such that the low temperature liquid is sprinkled onto at least a part of the upper half of the inner wall of the inlet chamber.

3. The vaporizer according to claim 1, wherein the means for sprinkling is installed such that the low temperature liquid can be sprinkled onto welding portions in the inlet chamber.

4. The vaporizer according to claim 1, further comprising a means for supplying the low temperature liquid to the inlet chamber at a higher flow rate than the means for sprinkling.

5. The vaporizer according to claim 4, further comprising 1st supply passage connected to the means for supplying the low temperature liquid from a low temperature liquid source, $2^{nd}$ supply passage connected to the means for sprinkling the low temperature liquid from the low temperature liquid source, and a flow rate varying means provided in said 2nd passage.

6. The vaporizer according to claim 5, wherein the flow rate varying means is a remote control valve.

7. The vaporizer according to claim 5, wherein the flow rate varying means is a temperature adjusting valve adjusting the flow rate of the low temperature liquid such that the temperature in the inlet chamber is maintained at a predetermined temperature.

8. A method for vaporizing a low temperature liquid comprising steps of cooling an inlet chamber by sprinkling the low temperature liquid in said inlet chamber, introducing the low temperature liquid into said inlet chamber from a supply portion, vaporizing the low temperature liquid in a heat transfer tube connected to said inlet chamber.

* * * * *